US006902453B2

(12) United States Patent
Switlik et al.

(10) Patent No.: US 6,902,453 B2
(45) Date of Patent: Jun. 7, 2005

(54) HIGH SECURITY OPENING APPARATUS FOR HERMETICALLY SEALED CONTAINERS

(75) Inventors: Stanley Switlik, Pennington, NJ (US); William C. Weber, Yardley, PA (US)

(73) Assignee: Switlik Parachute Company, Inc., Trenton, NJ (US)

( * ) Notice: Subject to any disclaimer, the term of this patent is extended or adjusted under 35 U.S.C. 154(b) by 0 days.

(21) Appl. No.: 10/438,468

(22) Filed: May 15, 2003

(65) Prior Publication Data

US 2003/0215162 A1 Nov. 20, 2003

Related U.S. Application Data

(60) Provisional application No. 60/380,991, filed on May 15, 2002.

(51) Int. Cl.[7] ..... B63C 9/125

(52) U.S. Cl. ..... 441/90; 441/442; 383/205; 383/210

(58) Field of Search ..... 441/90, 92, 94, 441/41, 42; 383/205, 210; 114/366, 367; 244/148, 149; 73/730

(56) References Cited

U.S. PATENT DOCUMENTS

| | | | | |
|---|---|---|---|---|
| 2,851,078 A | * | 9/1958 | Mellon et al. | 441/41 |
| 2,991,000 A | | 7/1961 | Spees | |
| 3,712,568 A | * | 1/1973 | Grasso et al. | 244/148 |
| 4,457,730 A | * | 7/1984 | Foster et al. | 441/94 |
| 4,522,305 A | | 6/1985 | Jacobsson | |
| 4,666,413 A | | 5/1987 | Klein et al. | |
| 4,838,429 A | * | 6/1989 | Fabisiewicz et al. | 383/205 |
| 5,342,230 A | * | 8/1994 | Louis | 441/42 |
| 5,378,066 A | * | 1/1995 | Wade | 383/205 |
| 5,792,959 A | * | 8/1998 | Marchant | 73/730 |
| 6,004,177 A | * | 12/1999 | Biesecker et al. | 441/92 |

FOREIGN PATENT DOCUMENTS

| | | |
|---|---|---|
| GB | 1122826 | 8/1968 |

* cited by examiner

*Primary Examiner*—Lars A. Olson
(74) *Attorney, Agent, or Firm*—Synnestvedt Lechner & Woodbridge, LLP; Richard C. Woodbridge, Esq.; Roy Rosser

(57) ABSTRACT

A flexible or semi rigid container having one or more openings, including, slits, slots, or shaped holes is sealed with a sealing apparatus. The sealing apparatus covers the openings and is attached to the container, sealing the openings and preserving the environment and integrity of the container. The sealing apparatus can have a visual indicator, which allows for rapid validation of the integrity of the seal.

16 Claims, 7 Drawing Sheets

HIGH SECURITY OPENING APPARATUS FOR HERMETICALLY SEALED CONTAINERS

CROSS-REFERENCE TO RELATED APPLICATIONS

This application claims priority from U.S. Provisional Application 60/380,991 filed on May 15, 2002, the full disclosure of which is hereby incorporated by reference.

BACKGROUND OF THE INVENTION

One goal of end-consumer packaging is to allow easy access but still maintain the integrity of the container and its contents including, for example, vacuum packing, pressurization, and water-tightness.

While such packages can be used for many purposes, one particularly rigorous use includes the packaging and protection of life-saving gear, including life vests, self-inflating life vests, life rafts and self-inflating life rafts, etc. The environment of use for such packages can often be harsh, with exposure to severe environmental conditions and physical hazards. Also, for both security and safety reasons, such life saving packages require frequent, e.g., daily, inspection to confirm package integrity and to detect tampering; such frequent handling can itself increase the risk of compromising the container integrity. Such uses require very heavy-duty, durable, and tear-resistant materials for the storage containers and a suitably heavy-duty sealing means that can withstand the severe conditions and hazards.

Accordingly, it would be desirable to provide a durable package, especially for inflatable items such as life vests and life rafts, which is still easily opened in an emergency. Many such inflatable products are now packaged in a vacuum to reduce space and to protect against the environment. Vacuum packaging also minimizes the likelihood of accidental inflations. Since such packages are frequently used in emergency conditions it is important to make it possible to open the package quickly with a minimum number of steps and maximum effectiveness. A special problem with vacuum packaging is that the vacuum itself puts a load on the vacuum-sealed fabric and makes it harder to break the seal. In addition, the vacuum packaging can prevent the movement, and resulting triggering, of any internal inflation device. Accordingly a clear need has arisen to produce a high strength, air-holding, sealed container having a seal that is simultaneously tamper evident, relatively easy to break, and is capable of triggering and assisting in the inflation and release of an inflatable device in the package, like a life raft or life vest.

Current containers and sealing means take advantage of the low tear resistance of the container material to create an opening in the container. This low tear strength characteristic is what makes the use of such materials impractical for today's harsh environments and heightened inspection—if the package tears too easily it violates the hermetic seal of the container. In the alternative, if highly tear resistant materials are used, the container is too difficult to tear open and an impediment for the end-user to open in an emergency.

Examples of current containers and sealing means include a sealed rubber bag such as that disclosed in British Patent 1,122,826 issued on Aug. 7, 1968 and entitled *Improvements In A Protective Bag For An Inflatable Life-Saving Apparatus*. The patent describes a sealed rubber bag containing a life raft and associated gas containers. A sealing strap and main pull cord are interconnected to facilitate a single action, staged sequential bag release and automatic inflation.

A single pull of the main cord unseals the rubberized, waterproof bag and simultaneously initiates the inflation of the life-saving apparatus inside. The container is sealed with a simple strip. Opening the container relies on the low strength of the sealing strip and the tearing of the sealing strip itself. This is necessary, in part, because current devices/packages rely upon the expanding raft to tear or break the seal and open the package. Furthermore, the sealing strip and the container have holes through which cords—used to activate the interior inflation device—are passed and then re-sealed with plastic or rubber. These holes present a major point of failure where the sealing means could be easily compromised, accidentally torn, or develop leaks.

U.S. Pat. No. 2,991,000 entitled *Tear Strip Means For Plastic Packaging* discloses a tough, multi-layer plastic pack (bag or pouch) suitable for vacuum packaging. Again, opening this container relies upon the low tear strength of the sealing "tear strip". Similarly, U.S. Pat. No. 4,522,305 entitled *Opening Arrangement For Packing Containers With Pressurized Contents*, comprises a multi-layer plastic bag (flexible wall pouch) for containing pressurized contents and also requires a low tear strength material.

U.S. Pat. No. 4,666,413 describes a *Life-Saving Appliance With A Gas-Tight Covering*, which comprises a vacuum-packed life-saving appliance, e.g., a life vest together with a pressure cylinder, which is surrounded by a thin plastic foil. The assemblage is then tightly surrounded by closely fitting hard foam casing as a protective measure. It appears that the entire assembly can be inflated by a pull. This container fully protects the life vest within but the size and rigidity, as well as the low strength of the materials, makes them unsuitable for the severe use and storage environment and intensive inspection regime needed for current containers.

A "clam-shell" or envelope type of package can be made with high-strength materials. The problem with these types of packages is that they are opened by separating two halves of the package; requiring the breaking or separation of at least three sealed seams or edges and can also result in the "sling-shotting" of the contents of the package as the two halves are forcefully pulled apart.

For security and safety reasons there is a need for a way to seal containers, especially containers comprised of flexible materials, while maintaining the structural integrity, including the maintaining of any hermetic, vacuum, or air-holding seal, of the container but which can be easily removed and thus opening the container to allow access to materials inside or to allow materials inside to be assembled or inflated, for example.

SUMMARY OF THE INVENTION

A high strength, air-holding, container, comprises a high-strength, tamper-resistant sealing means to hermetically or vacuum seal the flexible or semi-flexible container and maintain the seal in harsh environments and through repeated inspections and handling routines. This is achieved through the use of high tear strength material for both the container and the sealing apparatus. The use of high strength materials increases the durability of the container, lessening the possibility of damage during handling or rugged storage conditions. The sealing apparatus is attached to the container using a bonding means. The bonding means is selected to adjust the amount of force required to separate the sealing apparatus from the container, keeping that force below the tear strength of the container and sealing apparatus materials. The sealing means incorporates a grasping means, such as a handle, to facilitate removal of the sealing apparatus. The sealing apparatus can include an additional connecting means attached to the interior face of the sealing apparatus which communicates with the interior of the container. The other end of the connecting means can be attached to a device or trigger that will initiate inflation of a life raft or vest inside the container as the sealing apparatus is removed from the container resulting in the pulling of the connecting means. The components can be arranged so that as the sealing means is forcibly removed, the hermetic seal or vacuum is broken prior to the initiation of the inflation device or trigger. The materials used for the sealing means can be transparent or translucent which facilitates the inspection of the integrity of the seal.

By incorporating a clear or translucent material for the sealing apparatus in combination with a colored or tinted container or a colored or contrasting adhesive, an acutely visible indicator is provided to indicate whether the seal is intact or has been broken. This can assist in the inspection process by allowing a quick visual inspection to determine if any portion of the seal between the sealing apparatus and the container has been compromised.

The invention will be more fully understood by reference to the following drawings and detailed description.

DETAILED DESCRIPTION OF THE INVENTION

Figure 1:
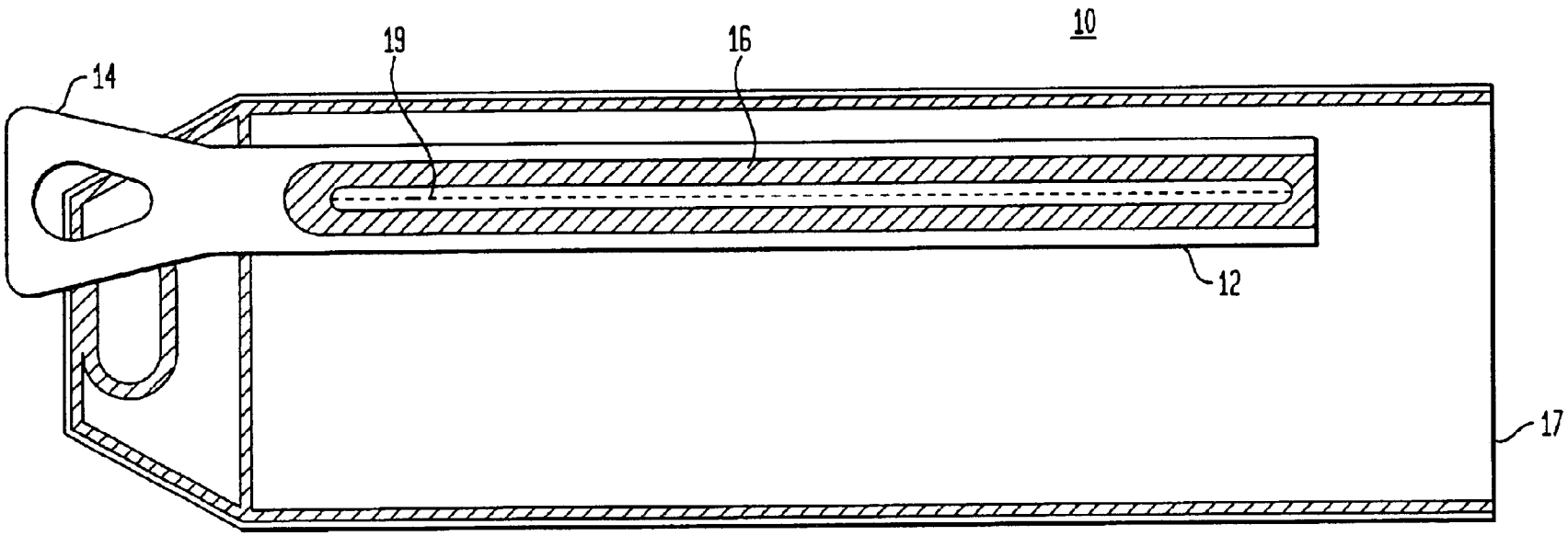
FIG. 1 is an illustration of a typical container incorporating the sealing apparatus of a preferred embodiment of the current invention.
Figure 2:
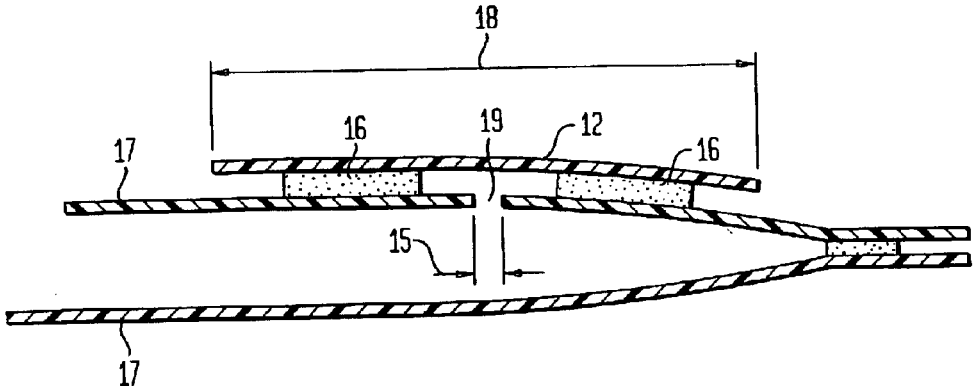
FIG. 2 is a side schematic of one method of construction of the sealing means.

During the course of this disclosure, like members will be used to identify like elements according to the different figures that describe the invention. The term "air-holding" will be used to refer to type of "hermetic" or "vacuum" seal and can be used interchangeably without effecting the scope or substance of the disclosure.

A high-strength flexible or semi-rigid container 10, 100, 200, 300, 400 is pre-configured with one or more openings 19, 119, 219, 319, 419. By pre-forming the openings, there is no need to require the user to tear the material of the container to create an opening and thus allows the use of very high tear strength materials. The openings can be of any size and any shape. The opening can be a simple, slit, slot, square, circle, or the like or can be a combination of one or more such shapes such as a "T" or "X". There are essentially no limitations to the size or shape of the openings in the container and the corresponding sealing apparatus on any container. Since the container and sealing means are constructed of high-strength materials, the size of the opening(s) can be large without reducing the structural integrity of the container.

The material for the container can be any suitable material that provides the level of protection required for the intended use; preferably, materials with a high tear strength to facilitate maintaining integrity during handling and also prevent unintentional tearing or puncture. Other properties for the materials can include, water resistance, acid resistance, non-permeable, caustic resistance, gas permeable, gas impermeable, selective gas permeability, heat resistance, flame retardant, flame resistance, and the like. Suitable container materials include, but are not limited to, plastic films, scrim, film-scrim laminates, coated cloth, vinyl, nylon, rubberized cloth, and the like.

One or more sealing apparatuses 12, 112, 312, 412 are attached to the container 17, 117, 117*c*, 217, 317, 417 and cover the pre-configured openings 19, 119, 219, 319, 419. The sealing apparatus preferably has a shape corresponding to the shape of the pre-configured openings having dimensions 18 larger than the dimensions of the opening 15 it is covering. This allows for the sealing apparatus to be attached to the container along the perimeter of all its edges without interfering with the opening. The excess dimension can be adjusted to provide more or less surface area for attachment; the surface area of the attachment can be used to adjust the force required to break the seal and separate the sealing apparatus from the container.

The sealing apparatus can be attached to the container by any method known in the art that is compatible with the materials to be attached and the intended environment of use. Such attachment can be accomplished, for example, using adhesives, heat-sealing, RF heat-sealing, ultrasonic sealing, and the like. It is preferred that the attachment method used, in combination with the materials used for the container and sealing apparatus, results in a seal that is air-holding. Additionally, the bonding strength of the attachment method can be selected to adjust the desired force required to separate the sealing means from the container.

Figure 3:
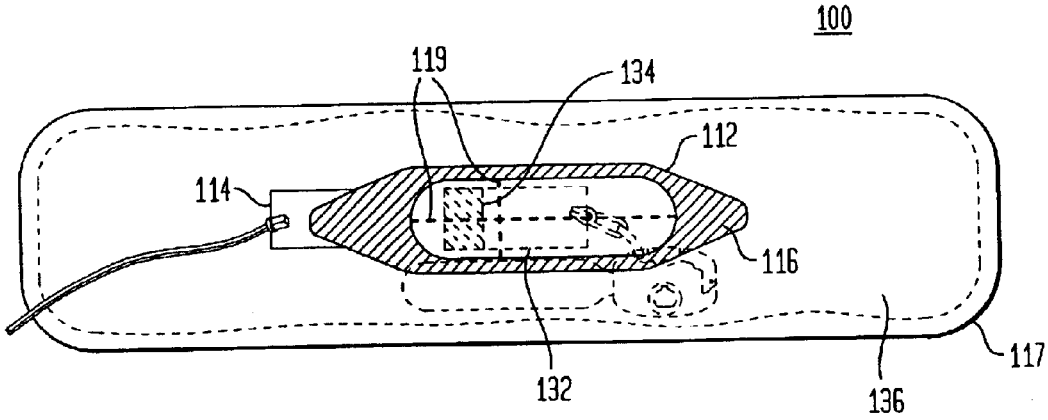
FIG. 3 is a top view of a device incorporating the sealing means with the additional connection strip shown.
Figure 4A:
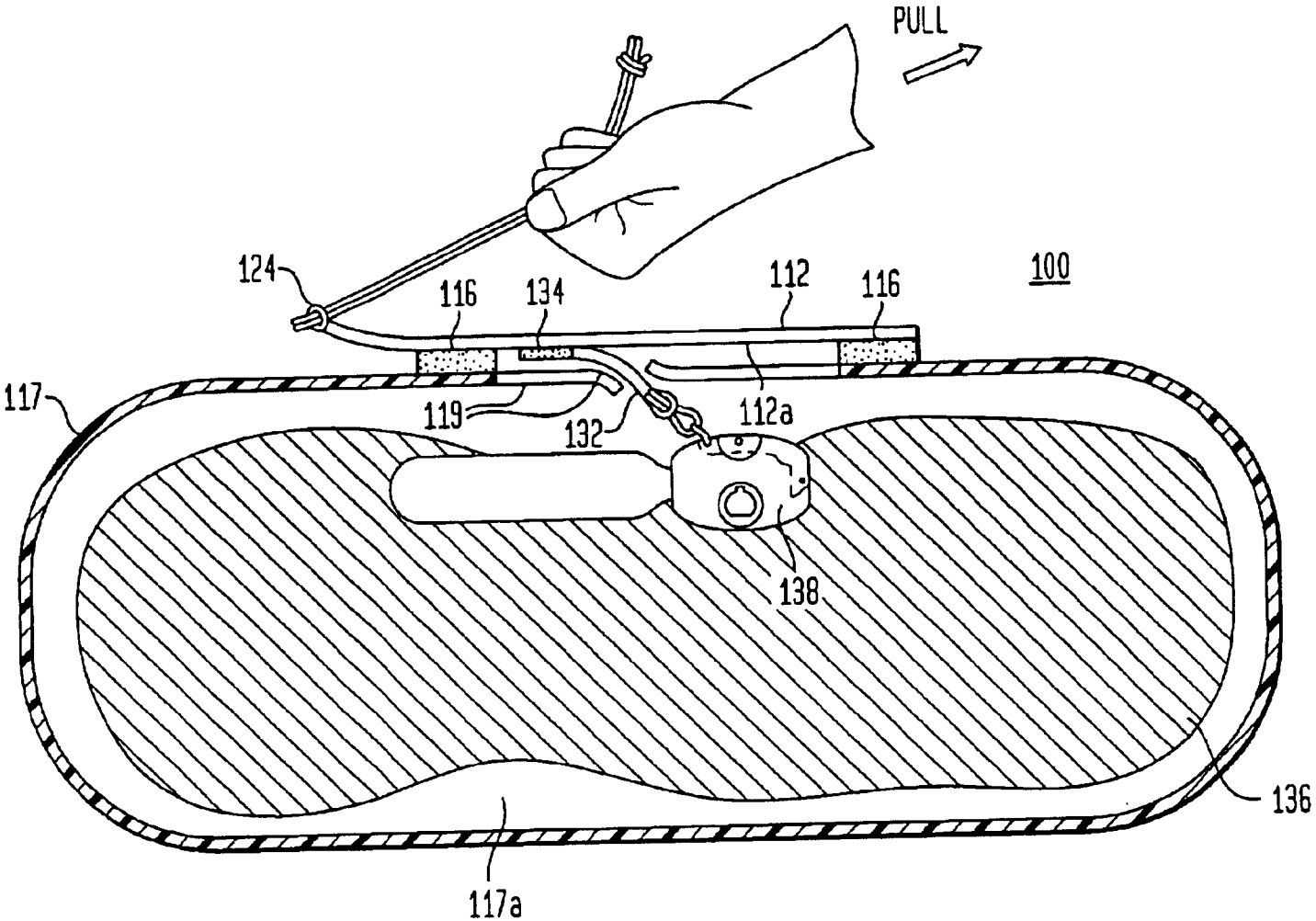
FIG. 4*a* is a cross-sectional illustration of a device incorporating the sealing means with the additional connection strip attached to an auto-inflation device.
Figure 4B:
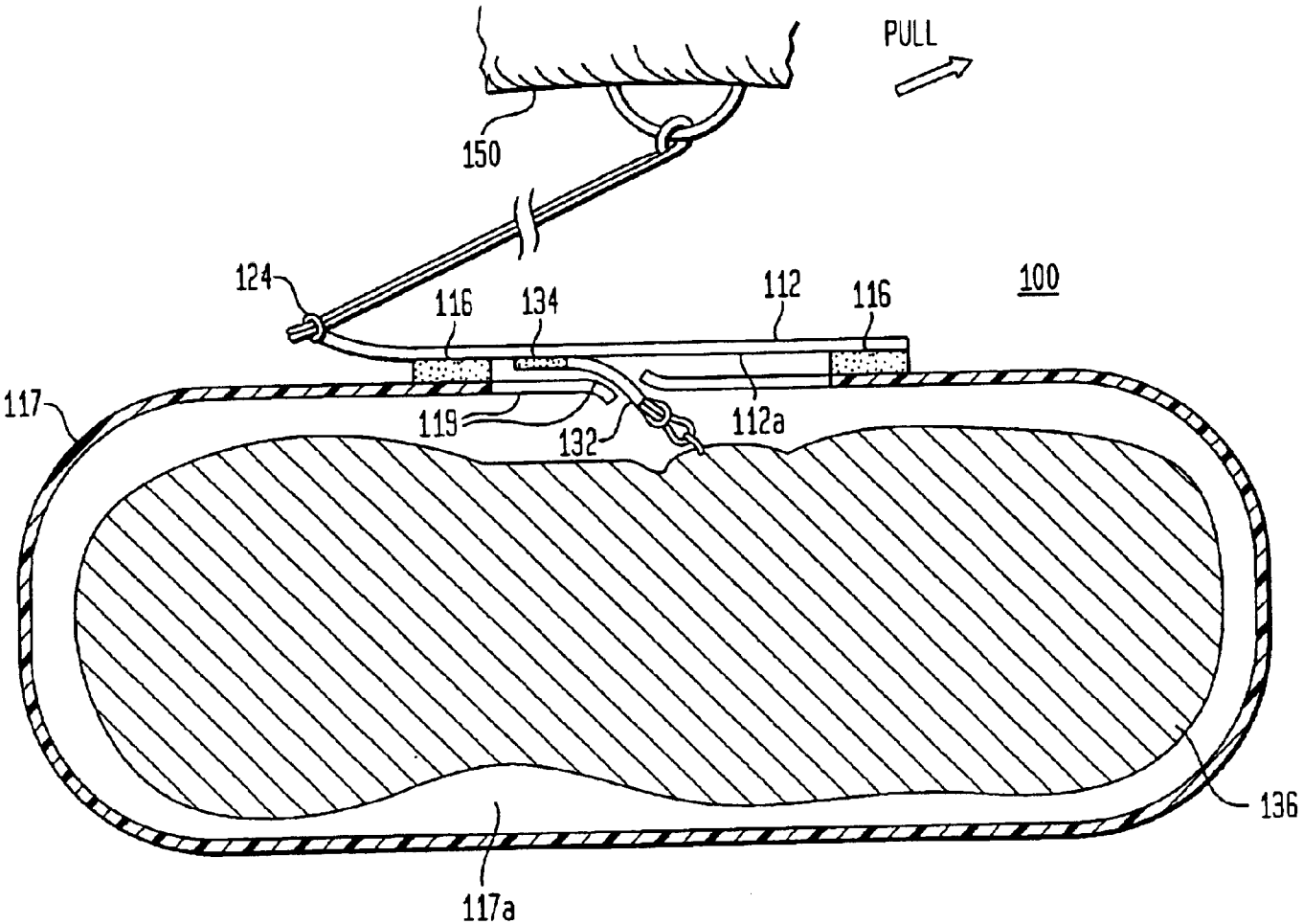
FIG. 4*b* is a cross-sectional illustration of a device incorporating the sealing means with the additional connection strip attached to a life raft inside.

In a preferred embodiment 100 (FIGS. 3, 4*a*, and 4*b*) the sealing apparatus contains a connecting means 132 for connecting the sealing apparatus to the contents 150 (such as a life raft) or to a mechanism 138 within the container 117. This connecting means 132 can be comprised of a length of cord, rope, webbing, chain, and the like. The connecting means is attached to the inside 112*a* of the sealing apparatus 112—the side of the sealing apparatus facing the inside of the container 117*a*, and is connected 134 at a location on the sealing apparatus 112 such that the connecting means is not sealed or attached to the container and can freely communicate with the interior of the container 117*a* and through the opening 119 which is covered and sealed by the sealing apparatus 112. The mechanism 138 can be, for example, an auto-inflation mechanism for a life raft 136.

The connection 134 between the connecting means 132 and the sealing apparatus 112 can be made via the same, similar or different methods as above, e.g., adhesives, heat sealing, ultrasonic sealing etc. It is preferred that the connection 134 maintain the air-holding properties of the sealed container, e.g., no puncturing the sealing apparatus such as by sewing.

The location of the connection 134 and the length and elasticity of the connecting means 132 can be selected such that when the seal between the container 117 and the sealing apparatus 112 is broken, the vacuum is released before the inflating device or trigger is initiated. One application for this internal connection is in the automatic deployment of a life raft from an ejection seat 150 during the ejection process from a fighter aircraft. By breaking the seal before the inflation of the raft, problems associated with a fully inflated raft dangling and flapping below the ejection seat during decent are eliminated. This allows for a water-activated inflation device, which would delay the inflation of the raft until the now un-sealed raft package hit the water below. Additionally, ejection-over-water altitudes are currently limited by regulation because rafts inflated at higher altitudes can over-inflate and burst. For weight conservation measures, such rafts are generally made of lightweight materials and their auto-inflation devices are designed to inflate to 2 p.s.i. at sea level. If these rafts are auto-inflated at higher altitudes, they can be over inflated and possibly burst; thus the restrictions on altitude of the ejection. Delaying the inflation of the raft using the present invention, the ejection can occur at higher altitudes and eliminate the need for the restrictions.

Figure 5A:
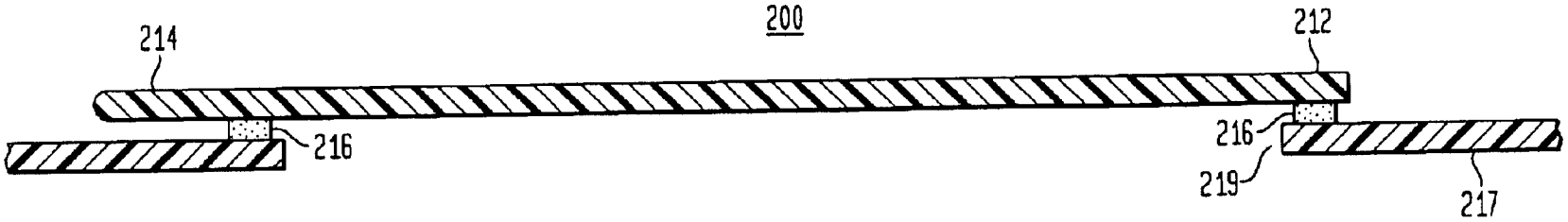
FIG. 5*a* is an illustration of a sealing apparatus with a tab.
Figure 5B:
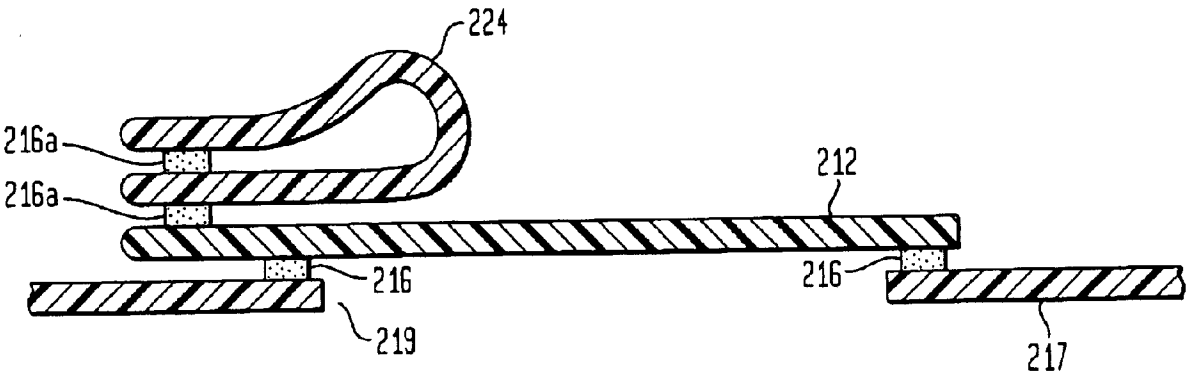
FIG. 5*b* is an illustration of a sealing apparatus with a handle.

The sealing apparatus (FIGS. 5*a* and 5*b*) preferably has a portion not attached to the container and outside the area of the opening 219 and the sealed area 216 to facilitate the removal of the sealing apparatus 212. In one preferred embodiment, the unattached portion of the sealing apparatus is in the form of a tab 214 (FIG. 5*a*) or a handle 224 (FIG. 5*b*) allowing the end user to easily grasp the sealing apparatus and pull to supply the necessary force to remove the sealing apparatus from the container. The tab or handle can be integral with the sealing apparatus (FIG. 5*a*) or a separate component that is attached 216*a* to the sealing apparatus (FIG. 5*b*).

There are no limitations to the size or shape of the slots/slits in the container and the corresponding sealing apparatus on any container. This can facilitate the creation of a large opening in the container, after separation of the sealing apparatus and still maintaining the structural integrity of the container.

Figure 7:
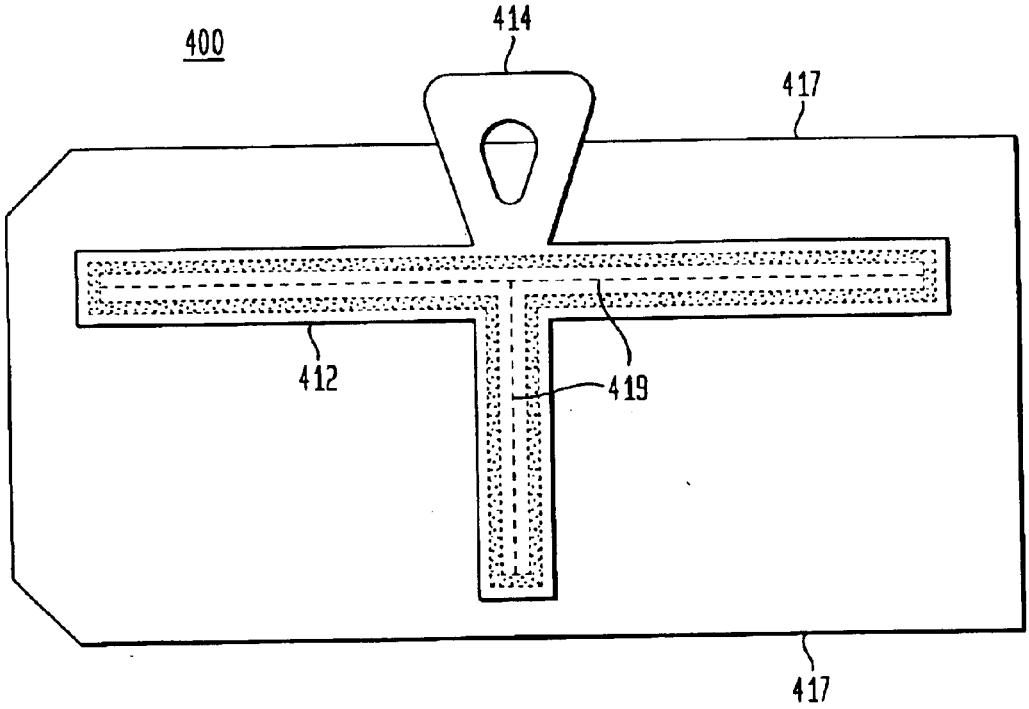
FIG. 7 is an illustration of a container having a complex opening and sealing apparatus.

FIG. 7 illustrates a container embodiment 400 including a sealing apparatus 412 having a complex shape to cover a compound slot/slit 419 in the container 417.

Figure 6A:
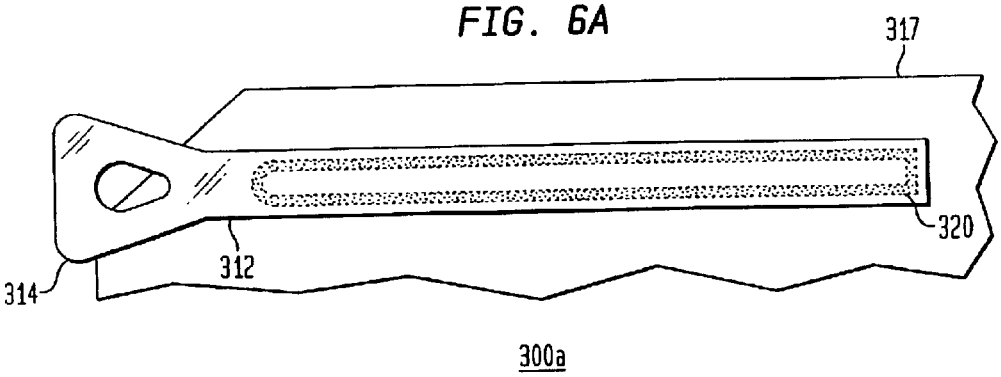
FIG. 6*a* is an illustration of a visual indicator showing an intact seal.
Figure 6B:
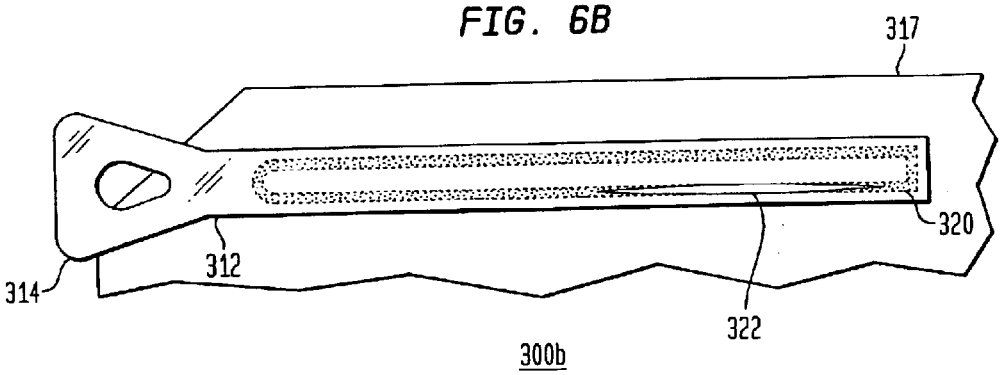
FIG. 6*b* is an illustration of a visual indicator showing a broken seal.
Figure 6C:
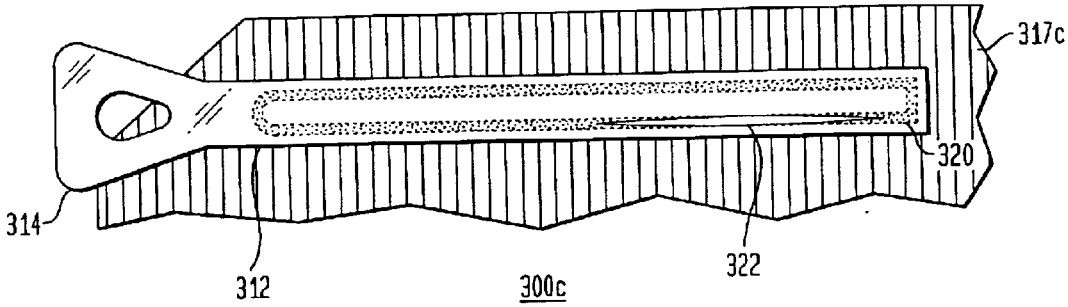
FIG. 6*c* is an illustration of a visual indicator attached to a colored material and showing a broken seal.

In one preferred embodiment 300, 300*a*, 300*b* (FIGS. 6*a*, 6*b*, 6*c*) the sealing apparatus 312 comprises a highly visible sealing indicator 320 which would facilitate easy, quick inspection of seal integrity. A preferred method utilizes color to differentiate between intact 320 and broken 322 seals. In one embodiment the sealing means is comprised of a transparent or translucent material. This can further be aided by the use of a colored or tinted material for the container 317 which will increase contrast between the sealing apparatus and the container and thereby also assist in the visual detection of any compromise in the seal integrity. In a preferred embodiment, a translucent sealing means 312 exhibits a colored visual indicator 320 when attached, such as by heat-sealing, to a colored container material 317*c*. This colored indicator will not be evident upon visual inspection at any point or section where the sealing means 312 and colored container 317*c* have become separated 322.

The foregoing invention allows a container including an inflatable life raft or life vest to be easily removed and inflated from a tamper evident, vacuum packed container with a single pull on a release handle or tab. It is especially useful in that the vacuum load normally working against the fabric opening on such a package doesn't significantly affect the ability of a person to open and inflate the inflatable device with a single continuous pull. Therefore, it is as easy for an elderly person or a child to open the container in an emergency as it is for a healthy adult.

EXAMPLES

An opening in a bag made of 60" translucent 9 oz flame retardant, vinyl fabric (Herculite T-9) was covered with a sealing means composed of red, 50" 18 oz flame retardant, vinyl coated fabric and sealed using RF heat-sealing. The bag was hermetically and maintained the hermetic seal.

An opening in a Raft Package made of 56" #107 navy 70-denier nylon taffeta, double coated with heat sealable urethane. (#2378-modified) was covered with a sealing means composed of 56" black 840 denier nylon fabric double coated with urethane (per SPC-QC-112 Rev E, shiny finish). The sealing means was RF heat sealed to the package. The package was vacuum-sealed and maintained the vacuum.

While the invention has been described with reference to the preferred embodiments thereof, never the less, the structure and steps that comprise the invention can be modified without departing from the spirit or scope of the invention as a whole.

What is claimed:

1. A pull through release sealing apparatus for releasibly sealing a container having an aperture therein and activating an activatable device housed in said container, said apparatus comprising:

a substantially flat sealing material having a dimension larger than said aperture in said container so that it substantially covers said aperture;

a hand grippable means connected to said flat sealing means;

a seal means for attaching said flat sealing material to said container in such a fashion that said flat sealing material forms a substantially air tight seal around said aperture; and substantially flat attaching means for connecting said flat sealing means to said activatable means inside of said container, and wherein a first force applied to said grippable means breaks a first part of said seal allowing air into the container, and wherein a second force applied to said grippable means breaks a second part of said seal and simultaneously activates said activatable means.

2. The apparatus of claim 1 wherein said substantially flat sealing means is at least translucent so that said aperture can be viewed from outside of said container.

3. The apparatus of claim 2 wherein said container maintains a relative vacuum with respect to the air outside of said container.

4. The apparatus of claim 3 wherein said activatable device inside of said container is an inflatable device having a pressurizing mechanism for inflating said inflatable device and said attaching means is attached directly to said pressurizing mechanism.

5. The apparatus of claim 4 wherein said inflatable device is a life vest.

6. The apparatus of claim 4 wherein said inflatable device is a life raft.

7. The apparatus of claim 4 wherein said grippable means comprises a handle.

8. The apparatus of claim 4 wherein said grippable means is connected to said activatable device by a continuous piece of material.

9. The apparatus of claim 3 wherein force applied to said grippable means breaks said seal and releases said vacuum prior to activating said activatable means.

10. The apparatus of claim 1, wherein said second force is applied immediately after said first force.

11. An opening apparatus for a vacuum-sealed, flexible container having one or more pre-configured openings in one or more surfaces of said container; comprising:

one or more flexible sealing means removably attached to said one or more container surfaces;

bonding means for attaching said one or more sealing means to said one or more surfaces of said container; wherein said one or more sealing means are attached to said one or more container surfaces so that said one or more pre-configured openings are covered, resulting in a air-holding seal around said one or more pre-configured openings; and wherein vacuum packaging said container results in said flexible container and said flexible sealing means conforming substantially to a contained object; and further comprising an indicator means for indicating the integrity of the seal, wherein said indicator means is a colored indicator having at least two different colors each color indicating either a sealed or an unsealed container.

12. An attach-through release sealing apparatus for releasibly sealing a container having one or more apertures therein and having contents therein, said apparatus comprising:

a substantially flat sealing material having a dimension larger than said aperture in said container so that it substantially covers said aperture;

a handle means connected to said flat sealing means; a seal means for attaching said flat sealing material to said container in such a fashion that said flat sealing material forms a substantially air tight seal around said one or more apertures; and substantially flat attaching means for connecting said flat sealing means to said contents inside of said container, and wherein a first force applied to said handle means breaks a first portion of said seal while maintaining the connection between said flat sealing means and said contents, and wherein a second force applied to said handle breaks a second portion of said seal and removes said contents from said container.

13. The attach-through release sealing apparatus of claim 12, wherein said contents is a lifesaving device having a water activated auto-inflation mechanism.

14. The apparatus of claim 12, wherein said second force is applied immediately after said first force.

15. A pull through release sealing apparatus for releasibly sealing a container having an aperture therein and activating an activatable device housed in said container, said apparatus comprising:

a substantially flat sealing material having a dimension larger than said aperture in said container so that it substantially covers said aperture;

a hand grippable means connected to said flat sealing means;

a seal means for attaching said flat sealing material to said container in such a fashion that said flat sealing material forms a substantially air tight seal around said aperture; and a substantially flat attaching means for connecting said flat sealing means to said activatable means inside of said container, and wherein a force, applied in a direction that is substantially parallel to flat sealing material via said grippable means, peels said flat sealing material from said container, thereby allowing air into said container prior to activating said activatable means.

16. An attach-through release sealing apparatus for releasibly sealing a container having one or more apertures therein and having contents therein, said apparatus comprising:

a substantially flat sealing material having a dimension larger than said aperture in said container so that it substantially covers said aperture;

a hand grippable means connected to said flat sealing means;

a seal means for attaching said flat sealing material to said container in such a fashion that said flat sealing material forms a substantially air tight seal around said aperture; and a substantially flat attaching means for connecting said flat sealing means to said activatable means inside of said container, and wherein a force, applied in a direction that is substantially parallel to flat sealing material via said grippable means, peels said flat sealing material from said container, thereby allowing air into said container prior to removing said contents from said container.

* * * * *